US006006618A

United States Patent [19]

Yumiyama et al.

[11] Patent Number: 6,006,618

[45] Date of Patent: Dec. 28, 1999

[54] STARTER MOTOR WITH REAR BRACKET ELEMENTS FIXED BY THROUGH-BOLTS

[75] Inventors: Shigeru Yumiyama; Kazuyuki Mori; Atsushi Saeki, all of Hitachinaka, Japan

[73] Assignee: Hitachi, Ltd., Japan

[21] Appl. No.: 08/986,389

[22] Filed: Dec. 8, 1997

[30] Foreign Application Priority Data

Dec. 6, 1996 [JP] Japan ..... 8-326814

[51] Int. Cl.[6] ..... F02N 15/06

[52] U.S. Cl. ..... 74/7 A; 310/90

[58] Field of Search ..... 74/7 A; 310/83, 310/90, 239; 290/38 R, 46, 47, 48; 384/204, 903

[56] References Cited

U.S. PATENT DOCUMENTS

| | | | |
|---|---|---|---|
| 3,726,575 | 4/1973 | Moorman | 384/420 |
| 4,304,140 | 12/1981 | Ebihara | 74/7 R |
| 4,412,457 | 11/1983 | Colvin et al. | 74/7 A |
| 4,590,811 | 5/1986 | Kasubuchi | 74/7 E |
| 5,014,563 | 5/1991 | Isozumi | 74/7 R |
| 5,045,737 | 9/1991 | Yamauchi | 310/89 |
| 5,079,465 | 1/1992 | Schmidt | 310/90 |

FOREIGN PATENT DOCUMENTS

| | | |
|---|---|---|
| 3931256 A1 | 3/1990 | Germany . |
| 63-309767 | 12/1988 | Japan . |
| 7-310631 | 11/1995 | Japan . |

OTHER PUBLICATIONS

German Office Action dated Apr. 29, 1999 including translation.

Pamphlet of the company Bosch "Elektrische Startanlagen", 1972, p. 17 (publication of the VDT–UBE 501/1/10,72).

*Primary Examiner*—Thomas R. Hannon
*Assistant Examiner*—David Fenstermacher
*Attorney, Agent, or Firm*—Evneson McKeown Edwards & Lenahan P.L.L.C.

[57] ABSTRACT

A starter motor has a rotating armature with a rotating shaft on which a groove is formed, a rear bracket, and a cylindrical-shape yoke connected to a front bracket which supports a pinion shaft. A holder washer member is inserted rotatively in the groove and limits movement in the axial direction of the rotating armature. A holder plate member is provided with a brush holder member. The holder washer member is sandwiched in an axial direction between a step portion of the rear bracket and an inner peripheral portion of the holder plate member. An outer peripheral edge portion of the holder plate member is sandwiched between an outer peripheral edge portion of the rear bracket and a step portion of the yoke. As a result, the rear bracket is fixed by a through-bolt to the front bracket. In the starter motor structure the holder plate member can be fixed to the rear bracket without using a fixing component such as a screw.

5 Claims, 2 Drawing Sheets

STARTER MOTOR WITH REAR BRACKET ELEMENTS FIXED BY THROUGH-BOLTS

BACKGROUND AND SUMMARY OF THE INVENTION

This application claims the priority of Japanese patent application 8-326814, the disclosure of which is expressly incorporated by reference herein.

The present invention relates to a starter motor and, in particular, to a starter motor for starting an internal combustion engine in which using a holder washer member a movement in an axial direction of an armature of the starter motor is regulated.

Conventional techniques relating to aforementioned type of starter motor are disclosed, for example, Japanese patent laid open publication No. Sho 63-309,767 and Japanese patent laid open publication No. Hei 7-310,631.

In the former document, a holder washer member for relating a movement of a motor shaft is sandwiched through a holder plate member and a rear bracket, and further the holder plate member is fixed to the rear bracket using a fastening screw member. The holder washer member is then fixed.

Further, by fastening a through bolt which penetrates through the rear bracket in an axial direction, the rear bracket and a yoke are fixed to a front bracket which supports a pinion shaft of the starter motor.

On the other hand, the second mentioned document involves a holder washer member itself, however a manner for fastening the holder washer member is the same as that of the first mentioned document.

In general, the size of an armature of a starter motor for starting an internal combustion engine is set in response to a required performance (a torque and a rotation number). In a case where the armature has a large size and a mass of the armature becomes large, in response to those situations, the through bolt is made larger.

Further, in this case, in accordance with a vibration from an outside portion or a vibration of the armature itself, since a force for moving the armature in an axial direction becomes larger, also naturally a force added to the holder washer member becomes larger.

As a result, in the above stated conventional starter motor structures in which the screw member for fixing the holder plate member is necessary, it is necessary to provide a larger screw member many screw members, etc.

As a result, component cost and a manufacturing cost of the motor increase remarkably.

An object of the present invention is to solve the above stated various problems and to provide a starter motor in which a holder washer member is sandwiched through a holder plate member and a rear bracket, wherein without use of a fixing component such as a screw member, the holder plate member can be fixed to the rear bracket.

The above stated object is attained according to a starter motor comprising an armature having a motor shaft in which a circumferential direction groove is formed at a vicinity of an end portion and a commutator which is fixed to the motor shaft, a rear bracket for rotatively supporting the end portion of the motor shaft, a cylindrical shape yoke in which one side opening end of the yoke is fitted into the rear bracket and another side opening end of the yoke supports one of the motor shaft and a pinion shaft, a holder washer member which is inserted in the groove of the motor shaft and limits a movement in an axial direction of the armature, and a brush holder member for holding a brush member which slides in the commutator and is fixed to a holder plate member.

In the above stated starter motor, the holder washer member is sandwiched between an inner side portion in a radial direction of the rear bracket and an inner side portion in a radial direction of the holder plate member, an outer peripheral edge portion of the holder plate member is sandwiched between an outer peripheral edge portion of the rear bracket and one end of the yoke, and the rear bracket is fixed through an installing bolt which penetrates through in an axial direction of the rear bracket.

It is preferable to provide the starter motor in which the installing bolt is fastened and fixed to the front bracket through a through bolt which penetrates through in the axial direction of the rear bracket.

It is preferable to provide the starter motor in which the outer peripheral edge portion of the rear bracket is formed with a flat plate shape, a step portion is provided to the one end of the yoke, and the flat plate shape outer peripheral edge portion of the rear bracket and the outer peripheral edge portion of the holder plate member are installed to the step portion.

In the present invention, first of all, the outer peripheral edge portion of the holder plate member is sandwiched between one opening end of the yoke and the outer peripheral edge portion of the rear bracket and another opening end is fitted into the front bracket of the starter motor.

Accordingly, when the rear bracket is fixed by fastening the through bolt, since an axial force of the through bolt is acted on the holder plate member through the rear bracket and the yoke, the holder plate member is strongly fixed to the rear bracket.

And this time, since the holder washer member is sandwiched between the inner side portion in the radial direction of the holder plate member and the inner side portion in the radial direction of the rear bracket, the holder plate member is strongly fixed to the rear bracket.

BRIEF DESCRIPTION OF DRAWINGS

Other objects, advantages and novel features of the present invention will become apparent from the following detailed description of the invention when considered in conjunction with the accompanying drawings wherein.

DETAILED DESCRIPTION OF THE INVENTION

Figure 1:
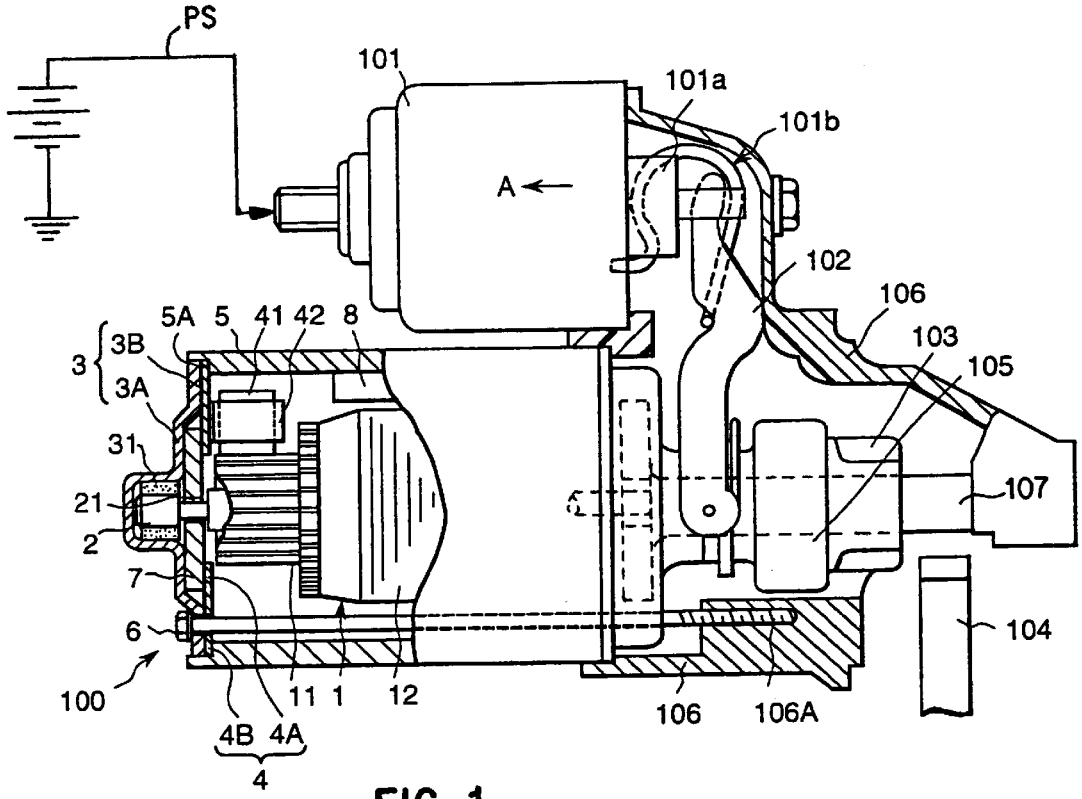
FIG. 1 is a cross-sectional view showing one embodiment of the entire structure of an automobile use starter having an automobile use starter motor according to the present invention.

Hereinafter, one embodiment of a starter motor according to the present invention will be explained referring to the drawings.

Figure 2:
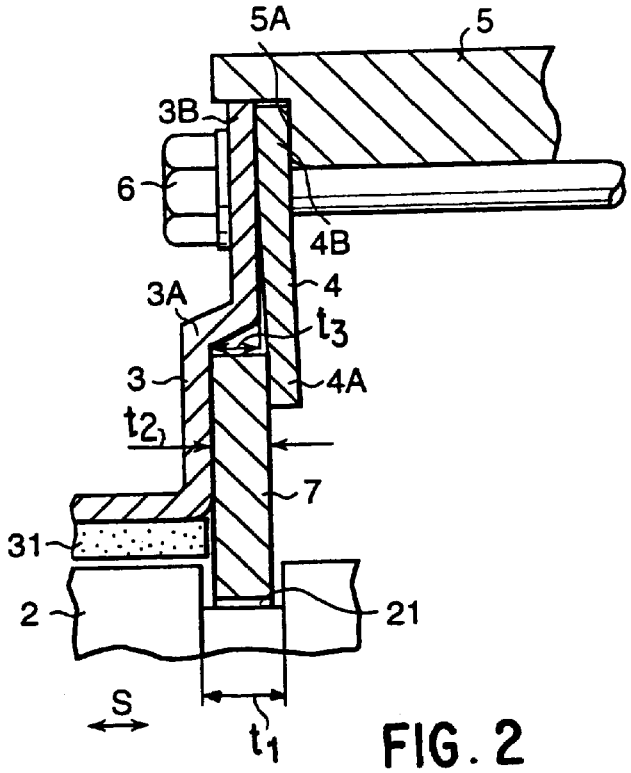
FIG. 2 is a partially enlarged view showing the starter motor structure shown in FIG. 1 according to the present invention.

FIG. 1 shows one embodiment of a whole structure of an internal combustion engine starting use starter motor 100 according to the present invention, and FIG. 2 is a partially enlarged view showing the starter motor 100.

This embodiment of a starter motor according to the present invention is referred to as a shift lever system starter motor. The starter motor 100 comprises an armature 1, a motor shaft 2, a magnetic switch 101, a shift lever 102, a pinion gear unit 103, a ring gear 104, an overrunning clutch 105, and a front bracket 106 and a pinion shaft 107 supported by the front bracket 106.

In the above stated starter motor 100, the armature 1 is rotatively driven by an electric supply from a power source and a rotational force of the armature 1 is transmitted to the motor shaft 2. The pinion gear unit 103 is mounted on the motor shaft 2 and is meshed with the ring gear 104 at a side of an engine, and the overrunning clutch 105 transmits the rotation of the motor shaft 2 to the pinion gear unit 103 through a helical spline.

The shift lever 102 forces movement of the pinion gear unit 103 and the overrunning clutch 105 along to the motor shaft 2, and the magnetic switch 101 forces the shift gear 102 to operate. The front bracket 106 which includes the pinion gear unit 103 at an interior portion and supports rotatively the pinion gear unit 103.

Herein, a shaft on which the above stated pinion gear unit 103 is mounted functions as a pinion gear shaft in a two-axle system starter motor.

The embodiment of the stator motor 100 according to the present invention further comprises a rear bracket 3, a holder plate member 4, a cylindrical shape yoke 5, a field stator 8, a commutator 11, a magnetic iron core 12, a bearing member 31, a brush member 41, and a brush holder member 42.

In the embodiment of the stator motor 100 according to the present invention, the commutator 11 is connected to an armature coil (not shown) wound on the magnetic iron core 12, and the armature 1 has the motor shaft 2 to which the magnetic iron core 12 and the commutator 11 are fixed.

The field stator 8 is arranged at a surrounding portion and the rear bracket 3. The rear bracket 3 has the bearing member 31 which rotatively supports an end portion of the motor shaft 2. The brush member 41 is supplied with the electric current from an outside power source PS and is further forced to contact to the commutator 11 by pressing a brush spring member (not shown).

The brush holder member 42 holds the brush member 41, and the holder plate member 4 is provided on the rear bracket 3 to which the brush holder member 42 is attached. The cylindrical shape yoke 5 forms an appearance core shape of the starter motor 100; one side opening end (a left end in FIG. 1) of the yoke 5 is fitted into the rear bracket 3 and another opening end (a right end in FIG. 1) of the yoke is fitted into the front bracket 106.

A circumferential direction groove 21 is formed in the vicinity of an end portion of the motor shaft 2 at a side of the rear bracket 3. In this groove 21 a holder washer member 7 is rotatively inserted and the holder washer member 7 limits a movement in an axial direction (S direction in FIG. 2) of the armature 1. This holder washer member 7 is sandwiched at the axial direction through a step portion 3A and an inner peripheral portion 4A.

The step portion 3A is provided at an inner side portion of a radial direction of the rear bracket 3, and the inner peripheral portion 4A is provided at an inner side portion of a radial direction of the holder plate member 4.

In the yoke 5, a step portion 5A is provided at the one side opening end (the left end in FIG. 1). Into this step portion 5A, an outer peripheral edge portion 4B of the holder plate member 4 and an outer peripheral edge portion 3B of the rear bracket 3 are fitted. The outer peripheral edge portion 4B of the holder plate member 4 is sandwiched at the axial direction between the outer peripheral edge portion 3B of the rear bracket 3 and the step portion 5A of the yoke 5.

In the above stated sandwiched starter motor structure, as shown in FIG. 2, a dimension relationship among a width t1 of the groove 21, a thickness t2 of the holder washer member 7 and a step difference t3 of the step portion 3A is set to have t1>t2>t3. As a result, the holder washer member 7 can freely rotate with the motor shaft 2 and is supported so as to be unable to move in the axial direction according to a sandwiching tolerance, thereby the movement in the axial direction of the armature 1 can be limited.

The rear bracket 3 is penetrated through at the axial direction by a through bolt 6 which can assemble all components of the starter motor 100 to the front bracket 106. In a case where the through bolt 6 is fastened, all components of the starter motor 100 are fixed to the front bracket 106.

Figure 1A:
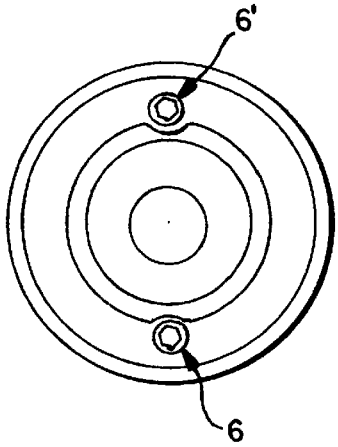
FIG. 1A is an end view of the starter motor of FIG. 1 showing two through-bolts.

Only one through bolt 6 is shown in FIG. 1, however two through bolts 6,6' as seen in FIG. 1A are provided on the rear bracket 3 at two places in the peripheral direction and the respective two through bolts are penetrated through spaces of the interior portions of the rear bracket 3, the holder plate member 4 and the yoke 5.

A tip end of the respective two through bolts is screwed and fixed to a screw hole 106A which is formed on the front bracket 106 and to this screw hole 106A the through bolt 6 is inserted. Further, a size of the through bolt 6 is selected to obtain enough of an axial force so as to assemble all components of the starter motor 100 to the front bracket 106.

The magnetic switch 101 comprises a plunger 101*a* and a torsion spring member 101*b*. The plunger 101*a* is sucked during an operation time of the magnetic switch 101 and to the torsion spring member 101*b* one end of the magnetic switch 101 is fixed. A rotational fulcrum of the shift lever 102 is supported through the torsion spring member 101*b* of the magnetic switch 101.

In the above stated embodiment of the starter motor structure according to the present invention, in a case where a key switch is presented to an "on" condition, the plunger 101*a* of the magnetic switch 101 is moved toward the direction of the arrow A, the pinion gear unit 103 is pushed out to a side of the ring gear 104 through the shift lever 102 and the plunger 101*a* is meshed with the ring gear 104.

On the other hand, during this time, a movable contact which is installed in an interior portion of the magnetic switch 101 is pushed out by the plunger 101*a* and is presented to an "on" condition and the electric current is supplied to the brush member 41 through a cable wiring not shown in figure, then the armature 1 of the starter motor 101 is rotated.

After that, the rotation of the armature 1 is transmitted to the overrunning clutch 105 through the motor shaft 2 and the helical spline, and this rotation is also transmitted to the overrunning clutch through the motor shaft 2. And this rotation is also transmitted to the ring gear 104 from the pinion gear unit 105 to cause the engine to be started.

In the above stated embodiment of the starter motor structure according to the present invention, between the step portion 5A which is positioned at the one side opening end of the yoke 5 and the outer peripheral edge portion 3B of the rear bracket 3, the outer peripheral edge portion 4B of the holder plate member 4 is sandwiched and the another opening end of the yoke 5 is installed to the front bracket 7.

Accordingly, by fastening the through bolt 6 when the rear bracket 3 is fixed to the front bracket 106, against to the holder plate member 4 the axial force from the through bolt 6 acts on the rear bracket 3 and the yoke.

Herein, a size of the through bolt 6 is selected to obtain enough axial force so as to install all components of the starter motor 100, and the holder plate member 4 is strongly fixed to the rear bracket 3.

The holder washer member 7 is closely sandwiched between the inner peripheral portion 4A of the holder plate member 4 and the step portion 3A of the rear bracket 3, and due to a sandwiched tolerance (t2–t3) the holder plate member 4 is unable to move toward the S direction shown by the double arrows in FIG. 2. As a result, the holder washer member 7 is strongly fixed to the rear bracket 3.

Namely, the holder plate fastening use screw member was used in the conventional starter motor structure however, in this embodiment of the starter motor structure according to the present invention, the holder plate fastening screw member is not used, since the holder washer member 7 can be strongly fixed to the rear bracket 3, whereby a component cost and a starter motor manufacturing cost can be reduced.

Further, where a large scale armature 1 is employed, by increasing the size of the through bolt 6 it can be corresponded to the large scale armature 1 structure. In the conventional starter motor structure, however, it is necessary to increase the size of the holder plate fastening screw member and also to increase the number of the holder plate fastening screw members.

However, in this embodiment of the starter motor structure according to the present invention, since it is unnecessary to increase the size of the holder plate fastening screw and it is unnecessary to increase the number of the holder plate fastening screw members, the cost increase for increasing the size and increasing the number of the holder plate fastening screw member can be eliminated.

Further, in the above stated embodiment of the starter motor structure according to the present invention, the starter motor 100 in this embodiment is applied to the starter structure in which the power transmitting portion is formed with the shift system.

However the present invention is not so limited and can be used with a starter structure in which a power transmitting portion is formed with an inertia sliding system. In this inertia sliding system starter structure, similar effects can be obtained.

Further, in the above stated embodiment of the starter motor according to the present invention, to the step portion 5A of the one end of the yoke 5, the outer peripheral edge portion 4B of the holder plate member 4 and the substantially flat plate shape outer peripheral edge portion 3B of the rear bracket 3 are sandwiched. Again, however, it is not limited to this starter motor structure but other various modifications are contemplated.

Figure 3:
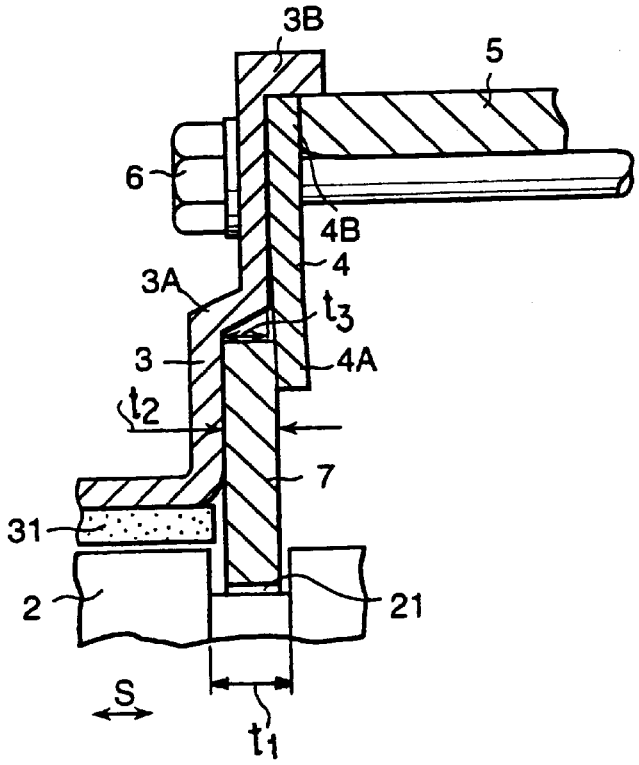
FIG. 3 is view showing a modified embodiment of the starter motor structure shown in FIG. 2 according to the present invention.

As one example of the various modifications, for example as shown in FIG. 3, an outer diameter of the rear bracket 3 is formed larger than that of the yoke 5 and, in the inner side of the outer peripheral edge portion 3B of the rear bracket 3, the outer peripheral edge portion 4B of the holder plate member 4 and a vicinity of the one end of the yoke 5 can be brought over.

In short, it is sufficient to sandwich the outer peripheral edge portion 4B of the holder plate member 4 between the outer peripheral edge portion 4B of the holder plate member 4 and the vicinity of the one end of the yoke 5. In this modification, the effects similar to the above described embodiment can be obtained.

According to the present invention, without of the use of the holder plate fastening screw member, the holder washer member can be strongly fixed, and the component cost and the starter motor manufacturing cost can be reduced.

Further, in the case where the large scale armature is required, the through bolt (the installing bolt) can be made larger, and since it is unnecessary to increase the size of the holder plate fastening screw member and increase the number of the holder plate fastening screw members, the above facts are necessary to carry out in the conventional starter motor structure, the cost increase in the holder plate fastening use screw member can be restrained.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A starter motor comprising:

an armature having a motor shaft in which a circumferential direction groove is formed at a vicinity of an end portion and a commutator which is fixed to said motor shaft;

a rear bracket for rotatively supporting said end portion of said motor shaft;

a cylindrical shape yoke in which a first side opening end of said yoke is fitted into said rear bracket and a second side opening end of said yoke supports one end of said motor shaft and a pinion shaft;

a holder washer member which is inserted in said groove of said motor shaft and limits a movement in an axial direction of said armature; and a brush holder member for holding a brush member in sliding contact with said commutator and is fixed to a holder plate member;

the starter motor wherein said holder washer member is sandwiched between an inner side portion in a radial direction of said rear bracket and an inner side portion in a radial direction of said holder plate member, an outer peripheral edge portion of said holder plate member is sandwiched between an outer peripheral edge portion of said rear bracket and said first side opening end of said yoke, and said rear bracket is fixed through at least one installing bolt which penetrates axially through said rear bracket such that said holder plate member is sandwiched in accordance with axial force of the at least one installing bolt to regulate movement thereof in an axial direction of said armature.

2. A starter motor according to claim 1, wherein said installing bolt is a through-bolt which is fastened and fixed to a front bracket by a screw hole which penetrates said front bracket in an axial direction with respect to said yoke.

3. A starter motor according to claim 1, wherein said outer peripheral edge portion of said rear bracket is a flat plate shape, a step portion is provided on said first side opening end of said yoke, and said flat plate shape and said outer peripheral edge portion of said holder plate are connected to said step portion of said yoke.

4. A method of starting an automobile engine comprising the step of utilizing the starter motor of claim 1.

5. A starter motor comprising:

a motor driven by an electric power supply;

a pinion shaft to which a rotation force of said motor is transmitted;

a pinion unit installed slidingly on said pinion shaft; and a front bracket for supporting rotatively said pinion shaft;

said motor comprising an armature which has a motor shaft in which a circumferential direction groove is formed at a vicinity of an end portion thereof and a commutator which is fixed to said motor shaft, a rear bracket having a bearing member which supports rotatively said end portion of said motor shaft, a cylindrical shape yoke which forms an outer core and a first opening end of said yoke is fitted into said rear bracket and a second opening end of said yoke supports said pinion shaft, a holder washer member which is inserted in said groove in the circumferential direction of said motor shaft and limits a movement in an axial direction of said armature, and a holder plate member attached to said rear bracket in which a brush holder member is attached thereto, holding a brush member which contacts said commutator, wherein said starter motor is configured to start an engine via rotation and meshing of a pinion gear of said pinion unit with a ring gear of said engine, said holder washer member is sandwiched between an inner side portion in a radial direction of said rear bracket and an inner side portion in a radial direction of said rear bracket and an inner side portion in a radial direction of said holder plate member, an outer peripheral edge portion of said holder plate member is sandwiched between an outer peripheral edge portion of said rear bracket and said first opening end portion of said yoke, and said rear bracket is fastened and fixed to said front bracket via a through bolt which penetrates through said rear bracket in an axial direction such that said holder plate member is sandwiched in accordance with axial force of the at least one installing bolt to regulate movement thereof in an axial direction of said armature.

* * * * *